US009731308B1

(12) United States Patent
Conrad, Jr.

(10) Patent No.: US 9,731,308 B1
(45) Date of Patent: Aug. 15, 2017

(54) CORRECTIONAL PAINT WAND

(71) Applicant: Michael L. Conrad, Jr., Bridgewater, NJ (US)

(72) Inventor: Michael L. Conrad, Jr., Bridgewater, NJ (US)

( * ) Notice: Subject to any disclaimer, the term of this patent is extended or adjusted under 35 U.S.C. 154(b) by 201 days.

(21) Appl. No.: 14/283,192

(22) Filed: May 20, 2014

Related U.S. Application Data

(60) Provisional application No. 61/944,559, filed on Feb. 25, 2014.

(51) Int. Cl.
*B05B 11/00* (2006.01)
*B05D 1/02* (2006.01)

(52) U.S. Cl.
CPC ..... *B05B 11/0059* (2013.01); *B05D 1/02* (2013.01)

(58) Field of Classification Search
CPC ..... B67D 5/52; B65D 83/14; B05B 11/0059
USPC ..... 222/135; 118/315
See application file for complete search history.

(56) References Cited

U.S. PATENT DOCUMENTS 3,084,871 A * 4/1963 Puglis ..... B65D 83/386 221/127
6,294,022 B1 9/2001 Eslambolchi
2007/0131714 A1 6/2007 Jutras

* cited by examiner

*Primary Examiner* — Dah-Wei D Yuan
*Assistant Examiner* — Andrew Bowman
(74) *Attorney, Agent, or Firm* — M&B IP Analysts, LLC

(57) ABSTRACT

A correctional paint wand used to mark lines on pavement, turf, concrete, and other surfaces. It has a rotatable sleeve on the lower end of an elongated handle, with the sleeve having at least two aerosol paint can holders each sized for containing one inverted paint can. At least one can applies distinguishable marking paint, and at least one can applies correctional paint visually covering erroneously applied markings, with the sleeve rotated to place the needed paint can in a dispensing position. A wheel on the lower end of the wand may aid its movement over the surface targeted for marking. The error correcting paint may be green for grass or artificial turf, brown for exposed ground, light gray or off-white for cement, and black for asphalt, or other colors appropriate to the intended application. Contemplated applications include, but are not limited to, use by landscaping designers and utility companies.

20 Claims, 6 Drawing Sheets

CORRECTIONAL PAINT WAND

CROSS-REFERENCES TO RELATED APPLICATIONS

The applicant herein previously filed a U.S. provisional patent application 61/944,559 entitled "Correctional Paint Wand" on Feb. 25, 2014 for substantially the same subject matter, and he now respectfully requests domestic priority for this newly filed U.S. utility patent application herein entitled "Correctional Paint Wand" based upon his earlier-filed U.S. provisional patent application 61/944,559.

BACKGROUND

Field of the Invention

This invention relates to apparatus and systems used to mark paint lines on pavement, turf, concrete, and other surfaces, particularly to a correctional paint wand having a rotatable sleeve on the lower end of an elongated handle, with the sleeve having at least two aerosol paint can holders each sized for containing one inverted paint can. Although the terms 'paint can holders', 'inverted paint can', and 'aerosol paint can' are used throughout this disclosure, their use should be considered as exemplary, and not limiting. Thus, it is considered within the scope of the present invention to have the paint can holders on its rotating sleeve adapted for use with a variety of sizes and configurations of inverted spraying dispensers, such as but not limited to aerosol and non-aerosol dispensers, disposable and refillable dispensers, and dispensing cans and bottles. It is also considered within the scope of present invention applications for it to be used in the dispensing of other marking/correctional substances in addition to paint, so that unintended markings can be promptly covered and obscured. At least one inverted paint can supported by the sleeve applies a marking paint in a color that is distinguishable from the surface targeted for marking, and at least one other paint can supported by the sleeve applies correctional paint intended to visually cover erroneous or duplicate markings, with the sleeve manually rotated by the operator to place the needed paint can in the dispensing position. For example, if orange markings are to be applied to grass or artificial turf having a green color, one or two paint can holders can house inverted paint cans containing orange paint, while at least one holder houses an inverted paint can containing green paint to cover erroneous orange markings. A wheel on the lower end of the wand aids its movement over the surface targeted for marking. As an option, the wheel may be removable for freehand wand use. The error correcting paint may be green for grass or artificial turf, brown for exposed ground, light gray or off-white for cement, and black for asphalt, or other colors appropriate to the intended application. Contemplated applications include, but are not limited to, use by landscaping designers and utility companies.

Description of the Related Art

The marking of surfaces with long-lasting paint for later use is common in sporting events (such as organized long-distance bicycle rides to mark the course before and after intersections to provide confirmation of the intended route to participating cyclists), as well as by the landscaping, utility, surveying, and construction industries. Markings often need to remain in place for extended periods of time, and must be sufficiently rugged or permanent to survive adverse weathering influences during the term of need, including contact with vehicle tires, rain, intense heat, and UV radiation. As a result, once in place, the markings can survive for months and years, even though they no longer have a useful purpose. However, multiple markings in a single intersection or other location can become confusing, plus they are visually unattractive. In addition, marking mistakes are often made which result in unneeded markings that can also interfere with the ease of interpreting instructions left at a location. In some areas of the United States where long-distance recreational bicycle rides are staged on a frequent basis by differing organizations, a dozen or more sets of similar marked indicators can become placed at a single intersection, and although marked in what was originally thought to be a color distinguishable from others at the same intersection, directional markings can often be confused with others that have faded and become close in shade, making them ineffective. One option is to place a large painted "X" over the erroneous or duplicate paint markings to be ignored. However, the result can be visually messy, and still lead to confusion and/or delay. Another option is to spray completely over the area containing the erroneous, duplicative, or no-longer-needed paint markings, but that can be wasteful of time and resources, and also be visually unattractive (similar to a wall that has been partially painted over to cover graffiti). The present invention offers a new solution that reduces confusion and also substantially hides unsightly errors that would otherwise remain visible on the targeted surfaces for extended periods of time. When a mistake is made, the operator of the present invention correctional paint wand simply rotates the paint can holding sleeve at the bottom of its elongated handle so that an inverted paint can containing the needed correctional color of paint is placed into the dispensing position, thereafter applying the correctional color over the erroneous or duplicate marking or markings previously made. There is no need for the operator to reposition the orientation of, or otherwise manipulate, paint cans as all paint cans have an inverted orientation and are immediately ready for use once rotated into the dispensing position. It is simple, fast, reduces confusion and potential delay, and also makes the treated area more visually attractive.

Three marking devices are known that hold multiple aerosol paint cans, but all are distinguishable from the present invention. For example, the invention disclosed in U.S. Pat. No. 6,294,022 B1 to Eslambolchi (2001) shows three inverted spray cans attached to a wand, but the paint cans are used with an on-board stencil positioned below them for marking the stenciled message onto the ground or other surface. Also, U.S. Patent Application Publication 2007/0131714 to Jutras (2007) shows three inverted aerosol cans supported by a wand. However, the cans are aligned in a row for simultaneous application of paint on a targeted surface, and the Jutras Patent Application Publication contains no mention of the words "removal", "cover", "correction", or "cancellation". Instead it only mentions the three can arrangement providing faster coverage of the targeted surface. The third invention is disclosed on the http//shop-krylonindustrial.com website and identified as a Line-Up® Pavement Striping Machine. It has one inverted aerosol can connected to an elongated handle, with a platform supporting the inverted can and also supporting additional upright aerosol cans to be used as replacement when the one currently in the dispensing position is empty. No correctional marking paint wand is known, nor any paint wand that functions in the same manner as the present invention, has the same structure disclosed herein, or provides all of the present invention's important advantages.

BRIEF SUMMARY OF THE INVENTION

It is the primary object of this invention to provide a correctional paint wand that allows coverage of erroneously applied, duplicative, or no-longer-needed markings on grass, concrete, asphalt, and other surfaces to reduce visual confusion and delay in interpreting informational markings remaining at a targeted location. It is a further object of this invention to provide a correctional paint wand that improves the attractiveness of a targeted location by visually hiding superfluous permanent paint markings no longer having a useful purpose. Another object of this invention to provide a correctional paint wand that is made from strong and durable materials for repeat use. It is also an object of this invention to provide a correctional paint wand that allows for fast and easy movement of a new paint can into the dispensing position with minimal operator effort. A further object of this invention is to provide a correctional paint wand that provides secure and fixed positioning of all paint cans, and particularly the one in the dispensing location. In addition it is an object of this invention to provide a correctional paint wand with a rotating wheel or other movable support associated with the bottom portion of its handle for moving the wand over the surface targeted for marking. It is another object of this invention to provide a correctional paint wand with a removable wheel for use in applications where freehand wand manipulation is preferred or beneficial. It is also an object of this invention to provide a correctional paint wand for use by landscaping, utility, surveying, and construction companies. It is a further object of this invention to provide a correctional paint wand for use by those organizing sporting and other events to visually eliminate directional and other informational markings needed only for a single event. In addition, it is an object of this invention to provide a correctional paint wand with physical dimensions, handle configuration, and grips that make it comfortable for most operator use.

The present invention, when properly made and used, provides a correctional paint wand having a rotatable sleeve on the lower end of an elongated handle, with the sleeve preferably having three aerosol paint can holders each sized for containing one inverted paint can. At least one paint can applies a marking paint in a color that is distinguishable from the surface targeted for marking, and at least one paint can applies correctional paint intended to visually cover erroneously applied markings, with the sleeve rotated to place the needed paint can in a dispensing position. For example, if orange markings are to be applied to grass or artificial turf having a green coloring, one or two paint can holders can house inverted paint cans containing orange paint, while at least one holder houses an inverted paint can containing green paint to cover erroneous orange markings. If two surfaces with different colors are in a location targeted for marking, such as turf and cement, two inverted paint cans supported by the present invention sleeve may contain paint having correctional colors. A rotating wheel or other movable device on the lower end of the wand aids its movement over the surface targeted for marking. As an option, the rotating wheel may be easily removable and reattached to provide freehand wand use when advantageous. As another option, a friction-enhancing grip may be associated with the middle portion of the wand to assist in rotating the needed paint can holder into the dispensing position. The error correcting paint may be green for grass or artificial turf, brown for exposed ground, light gray or off-white for cement, and black for asphalt, or other colors appropriate to the intended application. Contemplated applications include, but are not limited to, use by landscaping, surveying, and utility companies.

COMPONENT LIST

Figure 1:
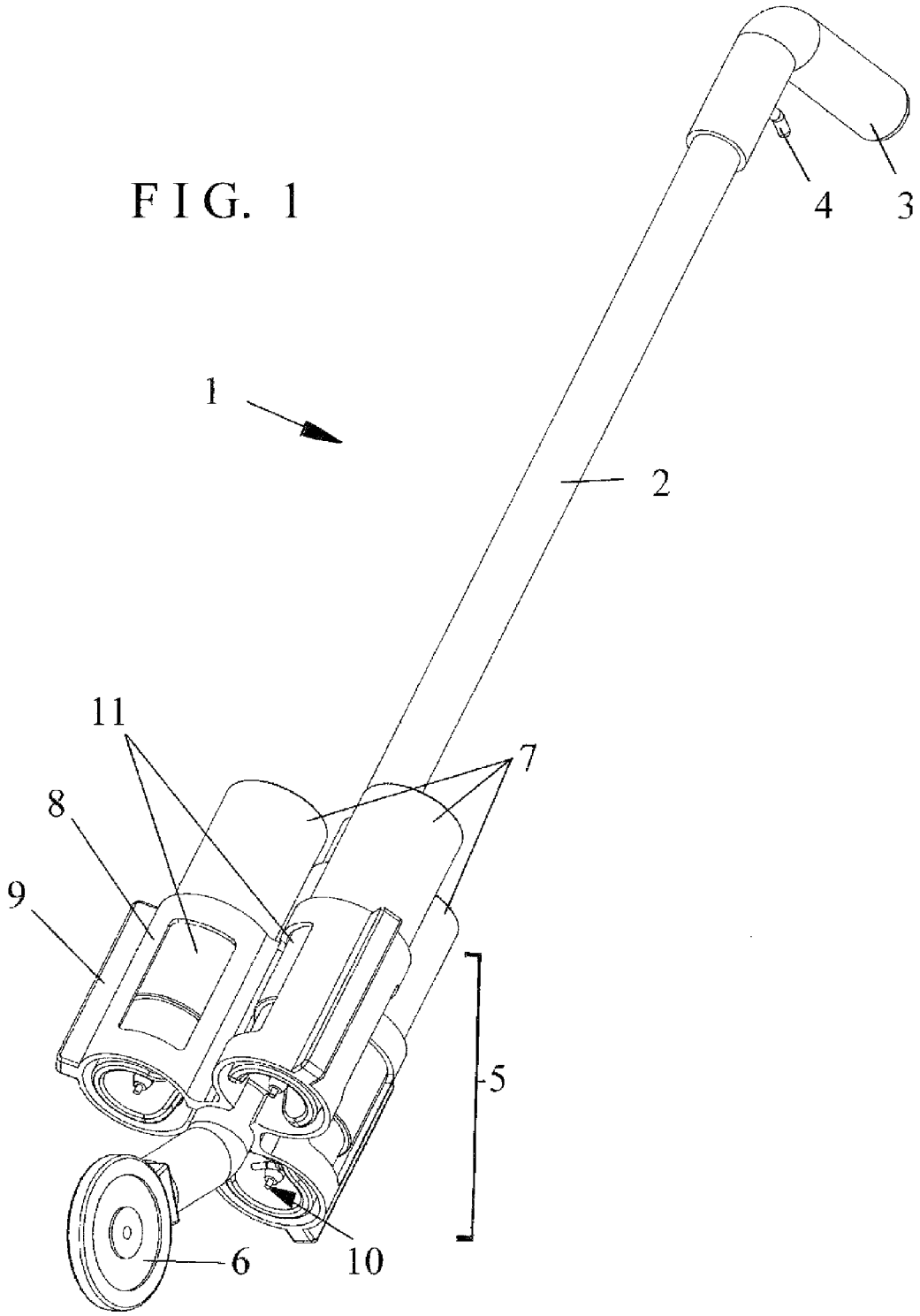
FIG. 1 is a perspective view from the bottom of a first preferred embodiment of the present invention correctional paint wand showing its elongated handle, a rotatable sleeve positioned near the lower end of the handle and configured to hold three inverted paint cans, the rotatable sleeve also having a protrusion on the outside surface of each paint can holder present that is configured to partially house a biasing element that helps to maintain an inverted paint can within its paint-can-receiving receptacle, with the biasing element preferably being a small rubber wheel that slightly deforms to tension the inserted paint can inwardly toward the handle, a grip on the upper end of the handle, a rotating wheel on the lower end of the handle below the sleeve, and a switch on or near the grip configured to activate paint spraying.

1—first preferred embodiment of correctional marking wand

1'—second preferred embodiment of correctional marking wand
2—elongated handle
3—hand grip
4—spray activation switch
5—rotating sleeve
5'—upper portion of rotating sleeve 5
6—rotating wheel (preferably removable and held in place by a single screw, but not limited to that type of connection to the lower end of handle 2)
7—inverted paint can
8—paint can holder
9—projection on outside of paint can holder 8 (partially houses a biasing element 22 that helps to maintain an inverted paint can 7 within paint can holder 8)
9'—smaller projection on outside of paint can holder 8 (partially houses a biasing element 22 that helps to maintain an inverted paint can 7 within paint can holder 8)
10—paint can nozzle
11—opening in side of paint can holder 8 (for viewing exterior of paint can 8 during rotation of sleeve 5 to place a new paint can 7 in the dispensing position, also makes sleeve 5 a little lighter in weight)
12—paint spraying actuator device (engages paint can nozzle 10)
13—inner member of high friction grip 14 that is placed in contact with handle 2
14—high-friction grip (encircles inner member 13)
15—textured exterior surface of high-friction grip 14 (can include spaced-apart ribs, a diamond-shaped pattern, small spaced-apart bumps, or other configuration)
16—spring stop
17—piston pins
18—springs
19—locator key
20—spring-loaded pull handle
21—sleeve extension around handle 2 used with spring-loaded pull handle 20 for its vertical deployment
22—biasing element (housed within projection 9 or smaller projection 9' and used to hold a paint can 7 securely in place within a paint can holder 8

DETAILED DESCRIPTION OF PREFERRED EMBODIMENTS

Figure 4:
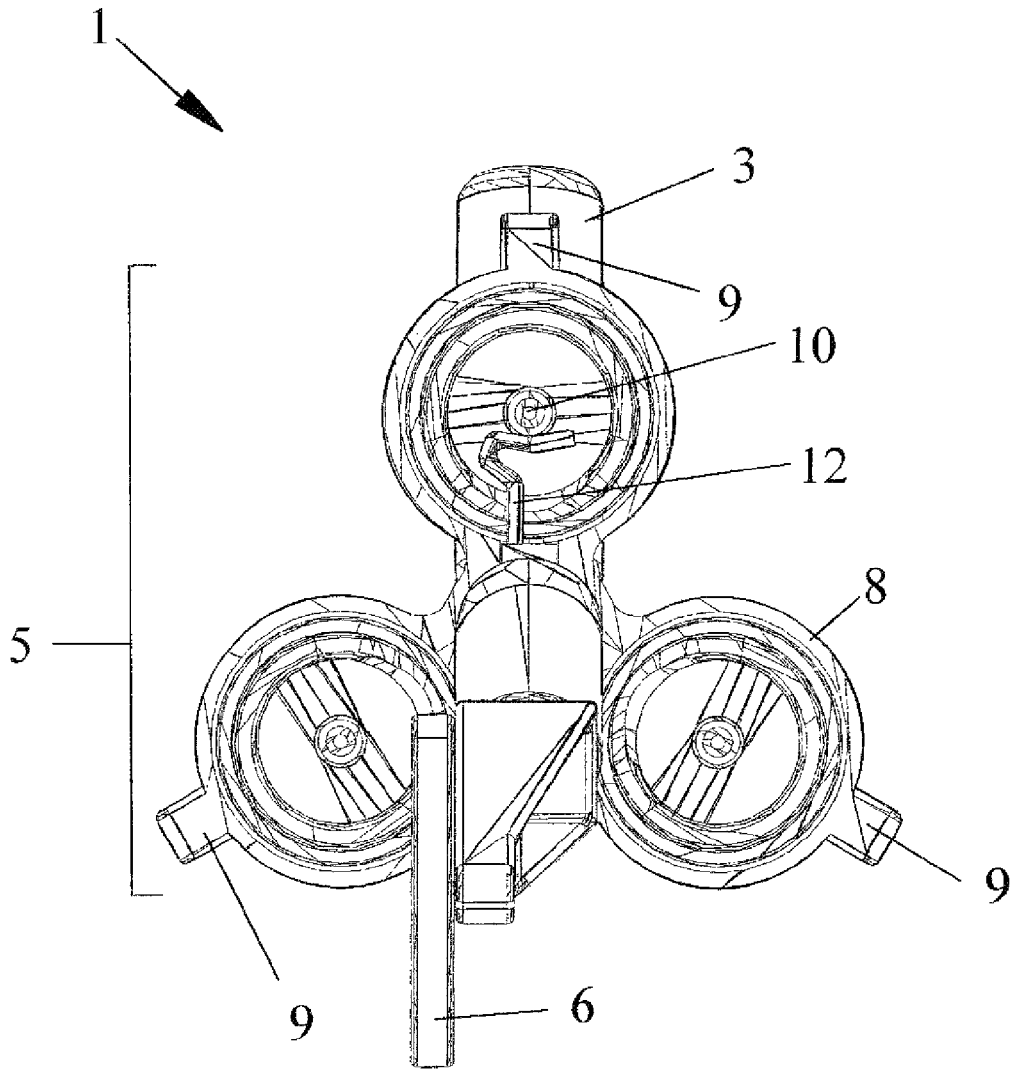
FIG. 4 is a bottom view of the first preferred embodiment of the present invention correctional paint wand showing the grip, the rotating wheel, and three paint cans supported by the sleeve, with the paint can in the dispensing position having a paint spraying actuator device located adjacent to its spray nozzle.
Figure 5:
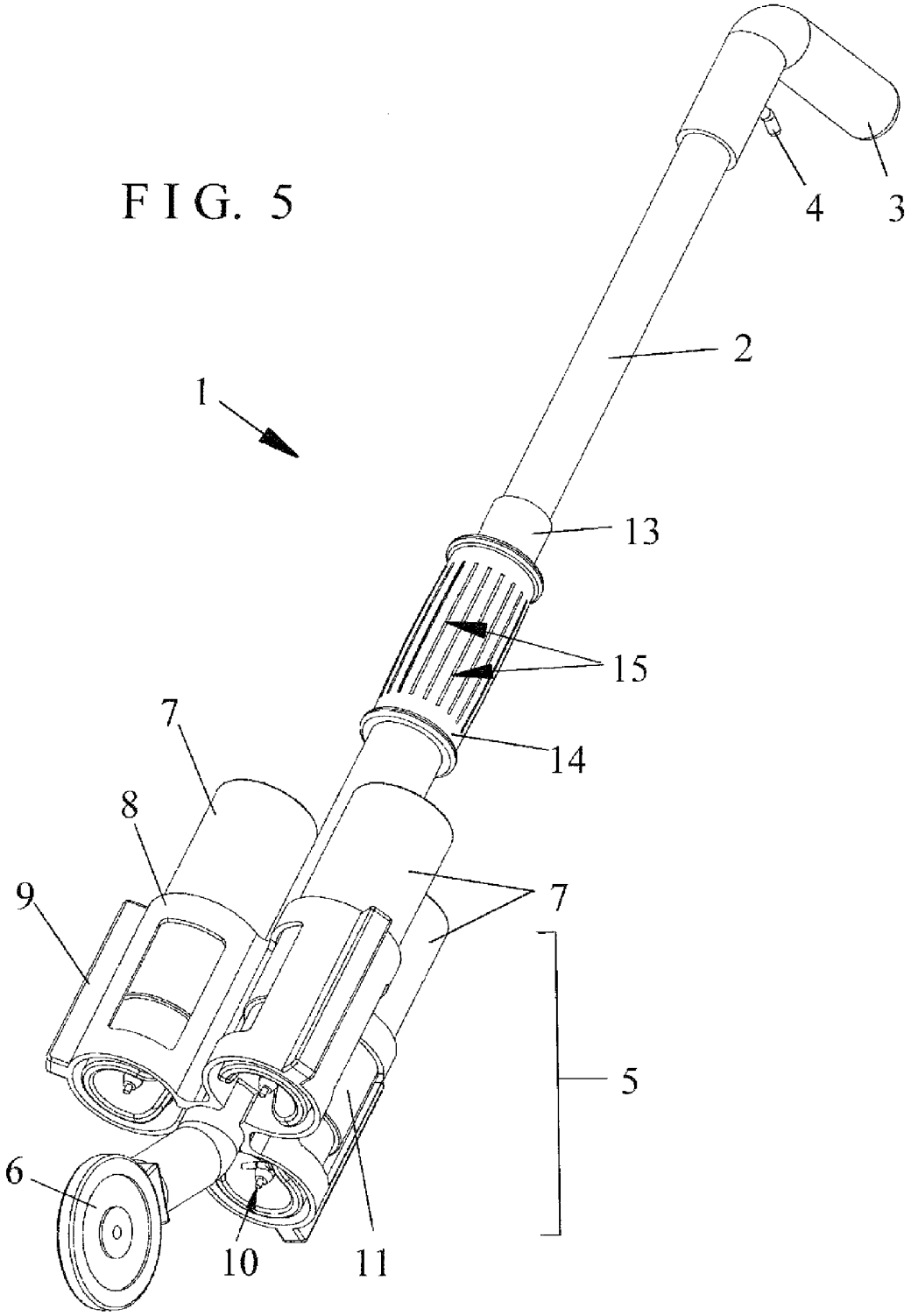
FIG. 5 is a perspective view from the bottom of the first preferred embodiment of the present invention correctional paint wand shown in FIG. 1 having a friction-enhancing grip associated with its handle in a position above its rotatable sleeve, of appropriate size and configuration for use by an operator to assist in the rotation of the needed paint can holder into the dispensing position.
Figure 6:
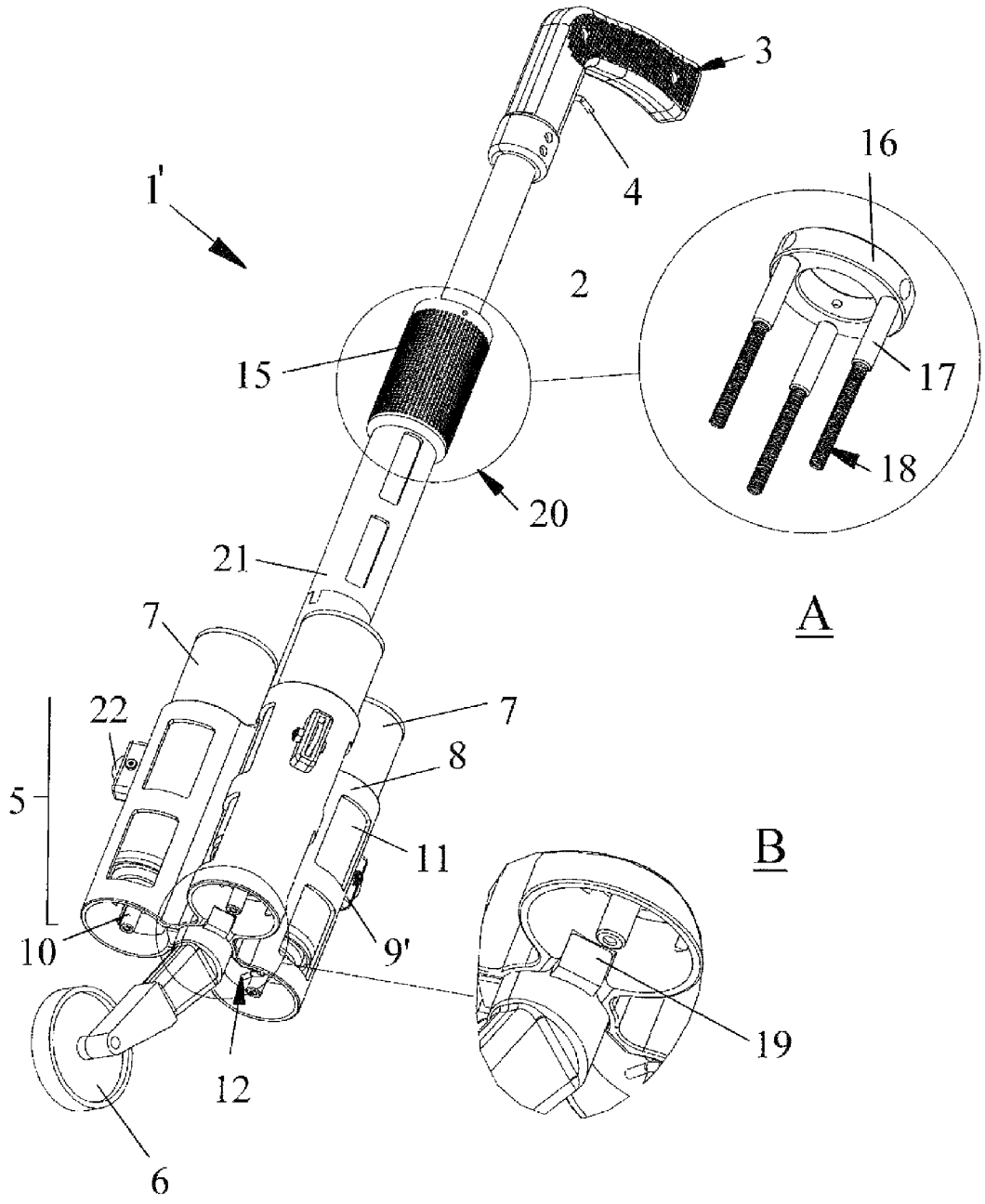
FIG. 6 is a perspective view from the bottom of a second preferred embodiment of the present invention correctional paint wand having a spring-loaded pull handle and locator key used for locking the position of the sleeve that holds inverted paint cans after its rotation to promptly and easily place a new paint can into the dispensing position, a grip on the upper end of the handle, a switch on or near the grip configured to activate paint spraying, a rotating wheel on the lower end of the handle below the sleeve which is optionally removable for free-hand use of the correctional paint wand, a textured exterior surface associated with the spring-loaded pull handle, a smaller projection associated with each paint can holder that partially houses a biasing element to keep an inverted paint can securely within the paint can holder during sleeve rotation and other correctional paint wand movement, and FIG. 6 further including an insert A showing an enlarged view of the spring stop, piston pins, and springs preferred in the spring-loaded pull handle and an Insert B showing an enlarged view of the dispensing end of paint can holders and the positioning of a locator key that defines the dispensing position.

FIGS. 1-6 show differing views and features of two preferred embodiments of the present invention correctional paint wand (1, 1') used to mark lines on pavement, turf, concrete, and other surfaces (not shown). Both have a rotatable sleeve 5 on the lower end of an elongated handle 2, with sleeve 5 having at least two aerosol paint can holders 8 each sized for containing one inverted paint can 7. At least one paint can 7 applies distinguishable marking paint (not shown), and at least one paint can 7 applies correctional paint to visually cover erroneously applied markings (not shown), with sleeve 5 rotated to place the needed paint can 7 in the dispensing position. A rotating wheel 6 on the lower end of the wand (1, 1', or other) aids its movement over the surface (not shown) targeted for marking. As an option, rotating wheel 6 may be configured for easy removal and reattachment to provide alternative freehand marking or correctional use of paint wand (1, 1', or other). FIG. 6 shows the second preferred embodiment 1' having a spring-loaded pull handle 20. The error correcting paint may be green for grass or artificial turf, brown for exposed ground, light gray or off-white for cement, and black for asphalt, or other colors appropriate to the intended application. Contemplated applications of correctional paint wand (1, 1', or other) include, but are not limited to, use by landscaping, surveying, utility companies, warehouses, and factories, as well as by organizers of sporting events, and other outdoor events such as parades, concerts, renaissance festivals, automobile shows, art and craft fairs, and the like.

FIG. 1 is a perspective view from the bottom of the most preferred embodiment of the present invention correctional paint wand 1 showing its rotatable sleeve 5 configured to hold three inverted paint cans 7, and sleeve 5 also having a protrusion 9 on the outside surface of each paint can holder 8 configured to partially house a biasing element 22 (see FIG. 6) that helps to maintain a paint can 7 within the paint-can-receiving portion of holder 8. Preferably, but not limited thereto, the biasing element is a small rubber wheel that slightly deforms to tension the inserted paint can 7 toward handle 2. FIG. 1 also shows correctional paint wand 1 having a handle 2 with a comfortable hand grip 3 on its upper end, and a rotating wheel 6 on its lower end below rotatable sleeve 5. Rotating wheel 6 may be removable and reattached to handle 2 according to need, and as an option (although not shown) one fastener may be used to secure rotating wheel 6 during its attachment to handle 2. In addition, hand grip 3 may have a dimension or configuration different from that shown, as long as it fulfills its needed function of providing a comfortable interface with a user's hand. On or near grip 3 on the upper end of handle 2, FIG. 1 also shows a spray activation switch 4 used by an operator of correctional paint wand 1 to activate paint spraying from the paint can 7 currently located in the dispensing position. Although the positioning and configuration of activation switch 4 is not considered as limited to that shown in FIG. 1, a configuration and positioning where it cannot be inadvertently activated are preferred. FIG. 1 further shows the paint can nozzles 10 under each inverted paint can 7 and the openings 11 in side of paint can holder 8 that are used for viewing the exterior of paint cans 7 during rotation of sleeve 5 to assist an operator in quickly moving a new paint can 7 capable of dispensing the needed color into the dispensing position. In addition, although three paint can holders 8 are shown in FIG. 1, more or less than that number is considered to be within the scope of the present invention. The length and/or configuration of handle 2 may be different from that shown without departing from the spirit and scope of the present invention. Also, grip 3 may have a different length or other dimension, and/or different surface texture, from that shown in FIG. 1. It is also not contemplated for spray activation switch 4 to be limited in configuration or size to that shown in FIG. 1. In addition, although a protrusion 9 extending from each paint can holder 8 is needed to partially house a biasing element (not shown) that helps to maintain an inverted paint can 7 within its paint-can-receiving receptacle, it is not critical that the size and configuration of protrusions 9 remain the same as that shown in FIG. 1, as long as they effectively fulfill their needed function of securing an inverted paint can 7 within the paint-can-receiving receptacle of the adjacent paint can holder 8. As an option (see FIG. 6), it is contemplated for sleeve 5 to be spring-loaded and biased into a lowered position with respect to handle 2. Thus, when a new paint can 7 needs to be moved into the dispensing position, an operator (not shown) can pull sleeve 5 upwardly and out of its secured/keyed positioning, rotate sleeve 5 in either direction to place the new paint can 7 into the dispensing position, and then release sleeve 5 so that it again has secure and fixed positioning relative to handle 2. To assist this rotation of sleeve 5, a friction-enhancing grip with a textured exterior surface may be associated with handle 2 in a position above rotatable sleeve 5 (for an example, see component numbers 14 and 15 in FIG. 6). Although rotating wheel 6 is shown with a definitive configuration in FIG. 1, such configuration should not be considered as limiting, as any wheel or other movement-assisting element or elements may be substituted.

Figure 2:
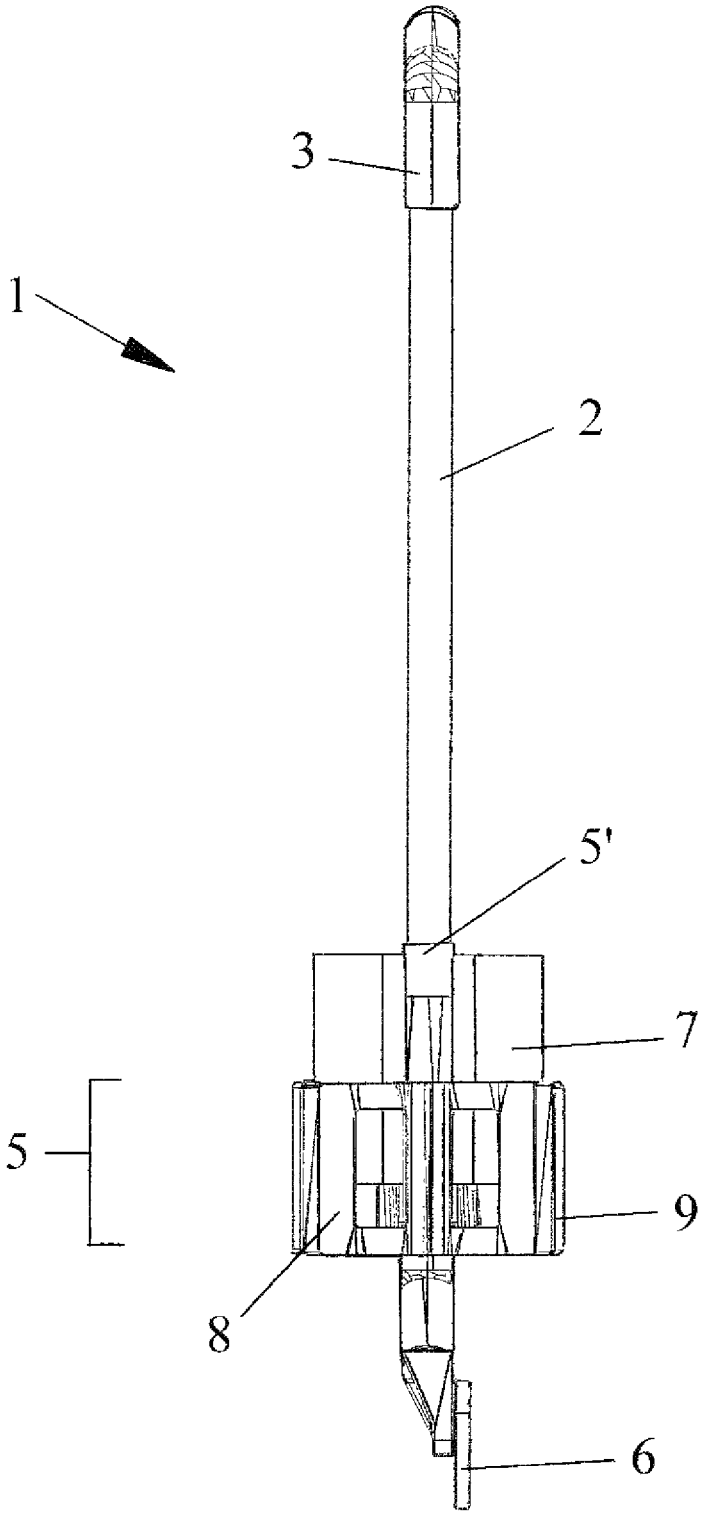
FIG. 2 is a front view of the correctional paint wand in FIG. 1 showing the elongated handle, grip, rotating sleeve, inverted paint cans, and the rotating wheel located at the bottom of the handle that may be optionally removable.

FIG. 2 is a front view of the correctional paint wand 1 in FIG. 1 showing elongated handle 2, grip 3 on the top end of handle 2, and rotating sleeve 5 supported by the lower portion of handle 2. FIG. 2 also shows inverted paint cans 7 supported by paint can holders 8 integral to sleeve 5, and rotating wheel 6 downwardly depending from the bottom end of handle 2. In this view, the activation switch 4 shown in FIG. 1 is obscured by hand grip 3 and handle 2. Also, the upper portion 5' of rotating sleeve 5 that is in contact with the exterior surface of handle 2, is shown between the inverted paint cans 7 held by rotating sleeve 5. As in FIG. 1, paint cans 7 are inverted during their use in the paint-can-receiving receptacle of an associated paint can holder 8. The rotating wheel 6 shown at the lower end of handle 2 in FIG. 2 may be configured and secured for easy removable and reattachment. However, the number, size, and configuration of rotating wheels 6, and its attachment means to the lower end of handle 2, are not considered critical or limited to that shown in FIGS. 1-6.

Figure 3:
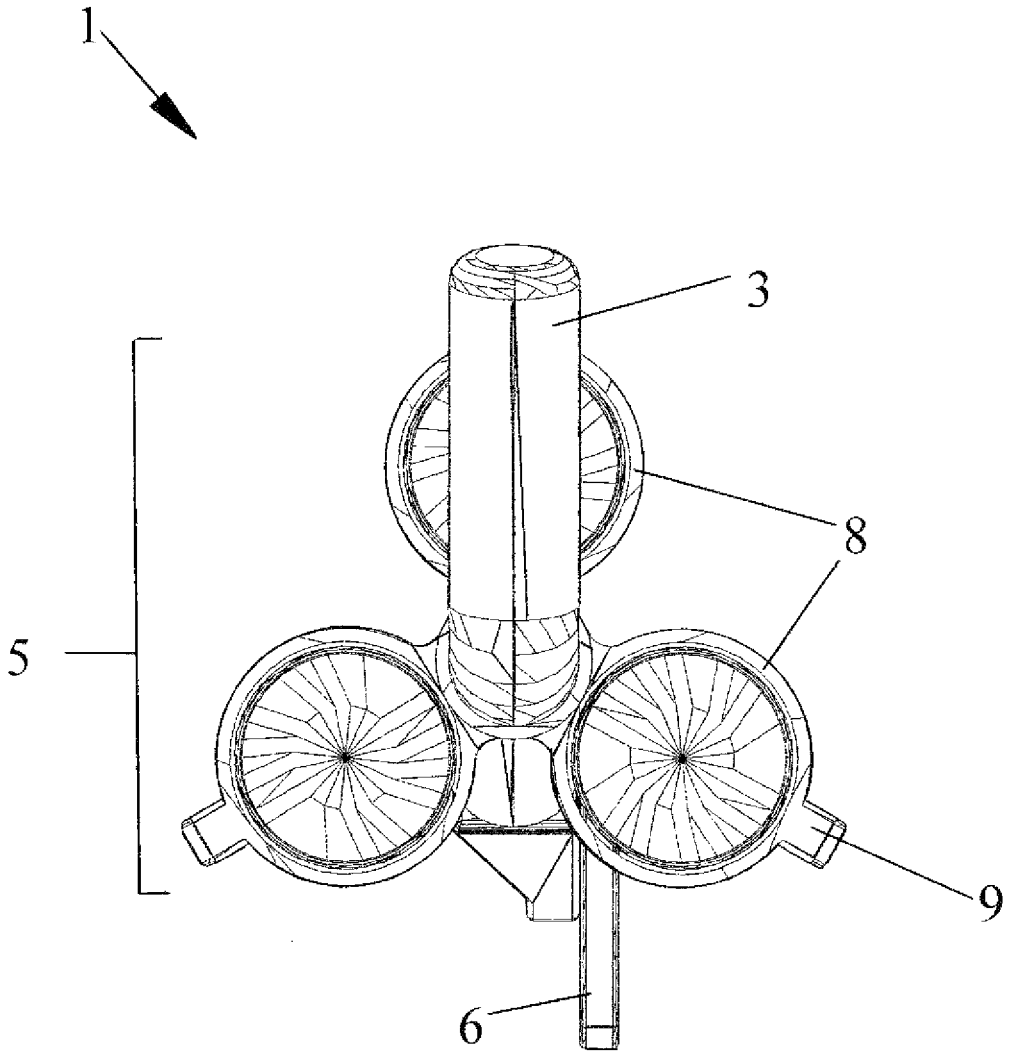
FIG. 3 is a top view of the correctional paint wand in the first preferred embodiment of the present invention showing the grip, a sleeve with three paint can holders each having a protrusion on the outside surface configured to partially house a biasing element that helps to maintain an inverted paint can within its paint-can-receiving receptacle, and a rotating wheel positioned below the sleeve.

In contrast, FIG. 3 is a top view of the correctional paint wand 1 in the most preferred embodiment of the present invention and shows grip 3 positioned above rotating sleeve 5, and sleeve 5 holding three paint cans 7 each in an independent paint can holder 8. FIG. 3 also shows two out of the three protrusions 9 present on the exterior surfaces of the paint can holders 8 in sleeve 5 that are configured to partially house a biasing element or elements that help to maintain an inverted paint can 7 in a fixed and secure position within the paint-can-receiving receptacle of the adjacent paint can holder 8. Preferably, but not limited thereto, the biasing element is a small rubber wheel (see wheel 22 in FIG. 6, as an example) that slightly deforms to tension the inserted paint can 7 toward handle 2. In addition, FIG. 3 also shows its associated rotating wheel 6 positioned below sleeve 5 that enables movement of correctional paint wand 1 over a surface (not shown) targeted for paint marking. However, rotating wheel 6 may be optionally removable for freehand use of correctional paint wand 1 according to need or operator convenience.

FIG. 4 is a bottom view of the most preferred embodiment of the present invention correctional paint wand 1 showing comfortable hand grip 3 positioned above the paint can holder 8 that is located in the dispensing position, wherein a paint spraying actuator device 12 is situated adjacent to the spray nozzle 10 of the paint can 7 ready for dispensing. To begin paint marking or correction, the operator (not shown) of correctional paint wand 1 engages activation switch 4 on or near hand grip 3 (hidden by the paint can holder 8 located in the dispensing position in FIG. 4, but shown in FIG. 1) that is in mechanical communication with paint spraying actuator device 12. FIG. 4 also shows the rotating wheel 6 that is preferred as a part of the most preferred embodiment of correctional paint wand 1, and a maximum of three paint cans 7 able to be supported by sleeve 5. However, although a sleeve 5 having three paint can holders 8 is optimal and preferred, a sleeve having two, four, or another number of other paint can holders 8 is also considered to be within the scope of the present invention for the same or differing applications. The relative sizes and configurations of the comfortable hand grip 3 and rotating wheel 6 shown in FIG. 4 should also not be considered as limiting.

FIG. 5 is a perspective view from the bottom of the most preferred embodiment of the present invention correctional paint wand 1 shown in FIG. 1 having a friction-enhancing grip 14 associated with its handle 2 in a position above its rotatable sleeve 5. It is contemplated for the size and configuration of friction-enhancing grip 14 to be appropriate for comfortable use by an operator while rotating sleeve 5 to place the needed paint can holder 8 into the dispensing position, and not limited to that shown. Although FIG. 5 shows high friction grip 14 having an inner member 13 that is placed in contact with handle 2, inner member 13 is not considered a critical feature thereof. Furthermore, high-friction grip 14 may be made from friction enhancing/increasing material, and/or the exterior surface of high-friction grip 14 may be textured, including the spaced-apart ribs 15 shown in FIG. 5, a diamond-shaped pattern, small spaced-apart bumps, and/or other friction-enhancing configurations.

FIG. 6 is a perspective view from the bottom of a second preferred embodiment of the present invention correctional paint wand 1' having a spring-loaded pull handle 20 above rotating sleeve 5 and connected to it via a sleeve extension 21, as well as a locator key 19 connected to handle 2 and positioned below rotating sleeve 5 that is used for locking the position of the rotating sleeve 5 after its rotation to promptly and easily advance a new paint can 7 into the dispensing position. FIG. 6 also contains two enlarged insets A and B used to show detail of the features and components of spring-loaded pull handle 20, including spring stop 16, piston pins 17, springs 18, and locator key 19. FIG. 6 further shows second preferred embodiment 1' having a more angular hand grip 3 on the upper end of handle 2 than is shown in FIGS. 1-5, an activation switch 4 on hand grip 3 that is configured to activate paint spraying from the paint can 7 in the dispensing position, a rotating wheel 6 on the lower end of handle 2 below sleeve 5 which is optionally removable for free-hand use of correctional paint wand 1' (according to preference or need). In addition FIG. 6 shows a textured exterior surface 15 associated with spring-loaded pull handle 20, a smaller projection 9' on each paint can holder 8 that partially houses a biasing element 22 to keep an inverted paint can 7 securely within its associated paint can holder 8 during sleeve 5 rotation and other correctional paint wand 1' movement. It is contemplated for the size and configuration of textured exterior surface 15 to be appropriate for comfortable use by an operator while revolving sleeve 5 and raising and lowering it around handle 2 to place the needed paint can holder 8 into the dispensing position. Furthermore, textured exterior surface 15 may be made from friction increasing material, and/or the exterior surface of high-friction grip 15 may be textured, including the spaced-apart ribs shown in FIG. 5, a diamond-shaped pattern, small spaced-apart bumps, or other friction-enhancing configurations. FIG. 6 further shows fixed sleeve 21 around handle 2 that is used in association with spring-loaded pull handle 20 for its vertical deployment.

It is preferred for sleeve 5 rotation means in the present invention (1, 1', or other) to be spring-loaded and have a keyed connection 19 to handle 2, however, other means of locking or otherwise stabilizing sleeve 5 so that the needed paint can holder 8 remains in the dispensing position during marking or correctional use are also contemplated to be within the scope of the present invention. Thus, to rotate sleeve 5 using the friction-enhancing grip 14 shown in FIG. 5, an operator (not shown) would place one hand on friction-enhancing grip 14, and with his or her other hand apply an upward force to sleeve 5 to release the keyed connection (19 or other), and use the hand in contact with sleeve 5 to rotate it in either a clock-wise or counterclockwise direction to position the paint can 7 needed next into the dispensing position where its nozzle 10 can be activated by switch 4 to dispense sprayed fluid from paint can 7. After the needed paint can 7 is placed into the dispensing position, the operator's hand then lowers sleeve 5 into downwardly until the keyed connection (19 or other) becomes engaged, and the keyed connection (19 or other) between sleeve 5 and handle 2 will maintain fixed and secure positioning for the paint can 7 in the dispensing position for predictable marking or correctional marking of surfaces without a risk of inadvertent movement that could otherwise cause marking errors. When the upward force is applied by an operator hand (not shown) to the spring-loaded pull handle 20 shown in FIG. 6, spring stop 16, piston pins 17, and springs 18 lift sleeve 5 upwardly to unlock keyed connection (19 or other) and allow rotation of sleeve 5 to place a needed paint can 7 into the dispensing position. When the upward force applied to spring-loaded pull handle 20 ceases, sleeve moves downwardly and returns to the area on handle 2 where the keyed connection 19 occurs, maintaining fixed and secure positioning for sleeve 5 and the paint can 7 in the dispensing position during marking and correctional use.

While the written description of the invention herein is intended to enable one of ordinary skill to make and use its best mode, it should also be appreciated that the invention disclosure only provides examples of specific embodiments and methods, and many variations, combinations, and equivalents also exist which are not specifically mentioned. The present invention should therefore not be considered as limited to the above-described embodiments, methods, and examples, or the language in the accompanying Abstract, but instead encompassing all embodiments and methods within the scope and spirit of the invention, as defined in the accompanying claims.

I claim:

1. A marking wand comprising:

an elongated handle having an upper end, a middle portion, and a lower end;

a rotatable sleeve associated with said lower end, said sleeve having at least two spray container holders, each spray container holder sized and configured for securely containing one inverted spray marking container including a marking composition and a dispensing nozzle; and a spray actuator device having a switch associated with said upper end of said elongated handle and a nozzle actuator associated with said lower end of said elongated handle, said nozzle actuator having a distal end, wherein the location of the distal end defines a spray container holder dispensing position, wherein said nozzle actuator is in communication with said switch, thereby allowing engagement of said switch to cause said nozzle actuator to engage the dispensing nozzle of the inverted spray marking container in the dispensing position and to cause release of the marking composition from the inverted spray marking container, wherein when a spray marking container is placed in an inverted position in at least one of said spray container holders while said spray container holder and said inverted spray marking container are not in the dispensing position and said sleeve is thereafter rotated until said spray container holder and said inverted spray marking container are in said dispensing position, said switch may be used to activate release of the marking composition from said inverted spray marking container.

2. The marking wand of claim 1 wherein each of said at least two spray container holders further comprises an internal biasing member situated to engage and securely position an inverted spray marking container within said spray container holder.

3. The marking wand of claim 2 wherein each said spray container holder has a protrusion positioned remotely from said handle, wherein each said biasing member comprises a deformable rotating wheel at least partially housed within said protrusion.

4. The marking wand of claim 3 wherein each said deformable wheel is made from rubber.

5. The marking wand of claim 1 further comprising a rotating support wheel associated with said lower end of said elongated handle, wherein said rotating support wheel allows for operator movement of said elongated handle and sleeve together with at least one inverted spray marking container over a surface targeted for marking.

6. The paint marking wand of claim 5 wherein said rotating support wheel is removable.

7. The marking wand of claim 1 further comprising a hand grip associated with said upper end of said elongated handle.

8. The marking wand of claim 7 further comprising a friction-enhancing grip associated with said middle portion of said elongated handle, wherein said friction-enhancing grip allows user rotation of said sleeve to place a different spray container holder in said dispensing position.

9. The marking wand of claim 1 further comprising a rotating wheel associated with said lower end of said elongated handle, a hand grip associated with said upper end of said elongated handle, and a friction-enhancing grip associated with said middle portion of said elongated handle.

10. The marking wand of claim 1 wherein said rotatable sleeve comprises three spray container holders, a rotating wheel associated with said lower end of said elongated handle, a hand grip associated with said upper end of said elongated handle, and a friction-enhancing grip associated with said middle portion of said elongated handle.

11. The marking wand of claim 1 wherein connection between said sleeve and said elongated handle is spring-loaded and keyed, allowing both clockwise and counter-clockwise rotation of said sleeve with respect to said elongated handle.

12. A method of using the marking wand of claim 1, said method comprising the steps of:

providing the marking wand of claim 1, at least one spray marking container configured as an aerosol paint can, and a surface in need of marking;

inserting each said at least one aerosol paint can needed for use in an inverted position within a different one of said spray container holders;

if said spray container holder containing the inverted aerosol paint can needed for use is not in said dispensing position, rotating said sleeve to place said needed inverted aerosol paint can in said dispensing position;

positioning said lower end of said elongated wand above said surface in need of marking; and activating said switch to cause release of sprayed paint onto said surface m need of marking.

13. The method of claim 12 wherein said at least one aerosol paint can further comprises paint selected from a group consisting of paint distinguishable in color from said surface in need of marking, and paint similar in color to said surface in need of marking for concealing erroneous markings and markings no longer needed thereon, and further comprising steps selected from a group consisting of a step of using paint distinguishable in color from said surface in need of marking for marking purposes and a step of using paint similar in color to said surface in need of marking for concealing erroneous and no longer needed markings.

14. The method of claim 13 further comprising at least two aerosol paint cans and wherein at least one of said aerosol paint cans contains paint distinguishable in color from said surface in need of marking and at least one of said aerosol paint cans contains paint similar in color to said surface in need of marking for concealing erroneous and no longer needed markings, and when marking said surface is desired further comprising a step of rotating said sleeve to place in said dispensing position a paint can holder containing an inverted aerosol paint can having paint distinguishable in color from said surface in need of marking, and when concealing erroneous markings and markings no longer needed is desired further comprising a step of rotating said sleeve to place in said dispensing position a paint can holder containing an inverted aerosol paint can having paint similar in color to said surface in need of marking.

15. The method of claim 12 wherein said marking wand of claim 1 further comprises a rotating support wheel associated with said lower end of said elongated handle, and further comprising a step of using said rotating support wheel to aid movement of said elongated handle and sleeve together over said surface in need of marking.

16. The method of claim 12 further comprising a hand grip associated with said upper end of said elongated handle, and a step of using said hand grip while moving said elongated handle and sleeve over said surface in need of marking.

17. The method of claim 16 further comprising a friction-enhancing grip associated with said middle portion of said elongated handle, and a step of using said friction-enhancing grip to assist in the rotation of said sleeve to place a different paint can holder in said dispensing position.

18. The method of claim 12 further comprising a rotating support wheel associated with said lower end of said elongated handle, a hand grip associated with said upper end of said elongated handle, and a friction-enhancing gnp associated with said middle portion of said elongated handle, and further comprising the steps of using said rotating support wheel to aid movement of said elongated handle and sleeve together over said surface in need of marking, using said hand grip while moving of said elongated handle and sleeve over said surface in need of marking, and using said friction-enhancing grip to assist in the rotation of said sleeve to place a different paint can holder in said dispensing position.

19. The method of claim 12 wherein said marking wand further comprises a sleeve having three paint can holders, a rotating wheel associated with said lower end of said elongated handle, a hand grip associated with said upper end of said elongated handle, and a friction-enhancing grip associated with said middle portion of said elongated handle, and further comprising the steps of inserting into at least one of said three paint can holders one of said aerosol paint cans containing paint distinguishable in color from said surface in need of marking, inserting into at least one of said three paint can holders one of said aerosol paint cans containing paint similar in color to said surface in need of marking for concealing erroneous and no longer needed markings, using said rotating support wheel to aid movement of said elongated handle and sleeve together over said surface in need of marking, using said hand grip while moving of said elongated handle and sleeve over said surface in need of marking, and using said friction-enhancing grip to assist in the rotation of said sleeve to place a different paint can holder in said dispensing position.

20. The method of claim 12 wherein connection between said sleeve and said elongated handle is spring-loaded and keyed, and further comprising a step of using said spring-loaded and keyed connection for clockwise and counter-clockwise rotation of said sleeve with respect to said elongated handle.

* * * * *